US010808345B2

(12) United States Patent
Ji

(10) Patent No.: US 10,808,345 B2
(45) Date of Patent: Oct. 20, 2020

(54) MULTILAYERED EMBROIDERED HEADWEAR

(71) Applicant: Jack Ji, Rugao (CN)

(72) Inventor: Jack Ji, Rugao (CN)

( * ) Notice: Subject to any disclaimer, the term of this patent is extended or adjusted under 35 U.S.C. 154(b) by 409 days.

(21) Appl. No.: 15/844,807

(22) Filed: Dec. 18, 2017

(65) Prior Publication Data

US 2019/0145036 A1 May 16, 2019

(30) Foreign Application Priority Data

Nov. 16, 2017 (CN) ..... 2017 1 1136030

(51) Int. Cl.

| | |
|---|---|
| ***D05C 5/00*** | (2006.01) |
| ***A42B 1/00*** | (2006.01) |
| ***A42B 1/04*** | (2006.01) |
| ***D05C 11/16*** | (2006.01) |
| ***D05C 17/00*** | (2006.01) |

(52) U.S. Cl.

CPC ..... *D05C 5/00* (2013.01); *A42B 1/004* (2013.01); *A42B 1/041* (2013.01); *D05C 11/16* (2013.01); *D05C 17/00* (2013.01)

(58) Field of Classification Search

CPC ..... D05C 11/16; D05C 17/00; D05C 5/00; D05C 7/00; A42B 1/004; A42C 1/008

See application file for complete search history.

(56) References Cited

U.S. PATENT DOCUMENTS

| | | | | | |
|---|---|---|---|---|---|
| 3,766,872 | A * | 10/1973 | Krieger | D04C 1/04 | 112/439 |
| 5,111,760 | A * | 5/1992 | Garzone, Jr. | D06Q 1/005 | 112/439 |
| 5,399,410 | A * | 3/1995 | Urase | D05C 1/08 | 112/439 |
| 5,947,044 | A * | 9/1999 | Lin | D05C 17/00 | 112/439 |
| 6,164,228 | A * | 12/2000 | Lin | D05C 17/00 | 112/439 |
| 6,263,817 | B1 * | 7/2001 | Tajima | D05C 17/00 | 112/439 |
| 6,925,947 | B2 * | 8/2005 | Lin | D05C 17/00 | 112/439 |
| 8,522,702 | B1 * | 9/2013 | Cho | D05C 17/00 | 112/100 |
| 8,939,096 | B2 * | 1/2015 | Yamanashi | D05B 19/12 | 112/102.5 |
| 2002/0096097 | A1 * | 7/2002 | Wang | D05C 17/00 | 112/475.18 |
| 2004/0226497 | A1 * | 11/2004 | Lin | D05C 17/00 | 112/475.22 |

(Continued)

*Primary Examiner* — Danny Worrell
(74) *Attorney, Agent, or Firm* — Hovey Williams LLP

(57) ABSTRACT

The present invention generally relates to layered embroidered headwear and methods for producing layered embroidered headwear. More particularly, the embroidering method of the present invention can produce headwear, including cap panels for producing the headwear, that comprises vivid decorations and designs, which are highly breathable and lightweight. As described herein, the embroidering method of the present invention can apply multiple levels of embroidering thread on top of each other to produce elaborate patterns or designs on the headwear without jeopardizing the breathability or weight of the headwear.

20 Claims, 2 Drawing Sheets

(56) References Cited

U.S. PATENT DOCUMENTS

| | | | | |
|---|---|---|---|---|
| 2008/0276489 | A1* | 11/2008 | Meschter | A43B 23/0265 36/12 |
| 2012/0199056 | A1* | 8/2012 | Bayram | D05B 23/00 112/475.08 |
| 2012/0222605 | A1* | 9/2012 | Lawley | D05B 35/06 112/475.19 |

* cited by examiner

MULTILAYERED EMBROIDERED HEADWEAR

RELATED APPLICATIONS

This application claims the foreign priority benefit of Chinese Patent Application Serial No. 201711136030.5, filed on Nov. 16, 2017, the entire disclosure of which is incorporated herein by reference.

BACKGROUND

1. Field of the Invention

The present invention generally relates to headwear and a process for producing headwear. More particularly, the present invention generally relates to a process for producing embroidered headwear with multiple embroidered layers.

2. Description of the Related Art

Generally, headwear articles, such as paneled caps, are designed to protect the wearer's head from the sun and weather. Paneled caps, such as five or six paneled baseball caps, are typically constructed from woven materials and may have decorations or designs added to the surface of the woven materials. Although this common paneled cap construction provides protection from the elements, it adds weight and texture to the inside of the cap, which may be uncomfortable to the wearer. Furthermore, the woven material may also interfere with the breathability of cap, thereby making the cap warm to wear.

Recently, embroidery has been a common method for adding designs onto headwear. The conventional embroidery method typically involves embroidering a design onto the surface of the woven fabric of the headwear; however, embroidery is generally limited to specified locations on the headwear and typically forms a design that is heavy and stiff. Consequently, such conventional embroidery methods generally add undesirable weight to the headwear, thereby forming headwear that is heavy and lacks breathability. Thus, one must generally give up comfort and breathability when adding decoration to headwear, especially when one adds decorations to all the panels forming a paneled cap.

Accordingly, it is desirable to develop a method to incorporate designs and decorations onto headwear that does not negatively affect the weight and breathability of the headwear.

SUMMARY

One or more embodiments of the present invention generally concern a method for producing embroidered headwear. Generally, the method comprises: (a) providing a substrate in the shape of a headwear panel; (b) embroidering a first embroidered layer with a first thread on a surface of the substrate, wherein the first embroidered layer covers at least 90 percent of the surface of the substrate; (c) embroidering a second embroidered layer with a second thread on at least a portion of the first embroidered layer; and (d) embroidering a third embroidered layer with a third thread on at least a portion of the first embroidered layer and/or on at least a portion of the second embroidered layer to thereby produce an embroidered headwear panel.

One or more embodiments of the present invention generally concern a method for producing embroidered headwear. Generally, the method comprises: (a) providing a substrate in the shape of a headwear panel; (b) embroidering a first embroidered layer with a first thread on a surface of the substrate, wherein the first embroidered layer covers at least 95 percent of the surface of the substrate; (c) embroidering a second embroidered layer with a second thread on at least a portion of the first embroidered layer; (d) embroidering a third embroidered layer with a third thread on at least a portion of the first embroidered layer and/or on at least a portion of the second embroidered layer to thereby produce an embroidered headwear panel; (e) repeating steps (a) to (d) to produce a second embroidered headwear panel; and (f) sewing the embroidered headwear panel and the second embroidered headwear panel together to form the embroidered headwear. In such embodiments, the embroidered headwear panel can comprise a basis weight of less than 160 gsm and exhibit an air permeability of at least 400 $ft^3$/min per $ft^2$ as measured according to ASTM D737-96.

One or more embodiments of the present invention generally concern an embroidered headwear article. Generally, the embroidered headwear article comprises at least one embroidered headwear panel, wherein the embroidered headwear panel comprises: (a) a substrate forming the shape of the embroidered headwear panel; (b) a first embroidered layer comprising a first thread embroidered on a surface of the substrate, wherein the first embroidered layer covers at least 95 percent of the surface of the substrate; (c) a second embroidered layer comprising a second thread embroidered on at least a portion of the first embroidered layer; and (d) a third embroidered layer comprising a third thread embroidered on at least a portion of the first embroidered layer and/or the second embroidered layer. In such embodiments, the embroidered headwear panel can comprise a basis weight of less than 160 gsm and exhibits an air permeability of at least 400 $ft^3$/min per $ft^2$ as measured according to ASTM D737-96.

BRIEF DESCRIPTION OF THE FIGURES

Embodiments of the present invention are described herein with reference to the following drawing figures, wherein.

DETAILED DESCRIPTION

The present invention generally relates to layered embroidered headwear and methods for producing layered embroidered headwear. More particularly, the embroidering method of the present invention can produce headwear, including cap panels for producing the headwear, that comprises vivid decorations and designs, which are highly breathable and lightweight. As described herein, the embroidering method of the present invention can apply multiple levels of embroidering thread on top of each other in order to produce elaborate patterns or designs on the headwear without jeopardizing the breathability or weight of the headwear. Consequently, the embroidering method of the present invention can address the deficiencies of the prior art headwear.

As discussed in detail below, the embroidering method of the present invention can form dimensional embroidered layers on headwear, in particular headwear panels, that may produce intricate design patterns through multiple layers of thread and thread density. Thus, unlike conventional embroidered headwear, which is typically heavy and stiff, the embroidered headwear of the present invention comprises embroidered designs and patterns that are lightweight and facilitate the breathability of the headwear.

Generally, in various embodiments, the embroidery method of the present invention comprises: (a) providing a substrate in the shape of a headwear panel; (b) embroidering a first embroidered layer with a first thread on a surface of the substrate; (c) embroidering a second embroidered layer with a second thread on at least a portion of the first embroidered layer; (d) embroidering a third embroidered layer with a third thread on at least a portion of the first embroidered layer and/or on at least a portion of the second embroidered layer to thereby produce an embroidered headwear panel; (e) repeating steps (a) to (d) to produce additional embroidered headwear panels; and (f) sewing the embroidered headwear panel and the additional embroidered headwear panels together to form the embroidered headwear. Each of the above-referenced steps are described in detail below. For exemplary purposes, the following method steps are described in reference to the production of a paneled cap comprising multiple panels. During such production method, the cap panels are individually produced and then sewn together as described below.

For ease of reference, FIGS. 1 to 4 depict the general structure of the embroidered cap panels at various stages during the embroidery method. It should be understood that the embroidered cap panels shown in FIGS. 1 to 4 are just one example of an embroidered cap panel according to the present invention. Thus, the present invention may include other embroidered cap panel embodiments not specifically depicted in FIGS. 1 to 4. The exemplary embroidered cap panel illustrated in FIGS. 1 to 4 will now be described in detail.

Figure 1:
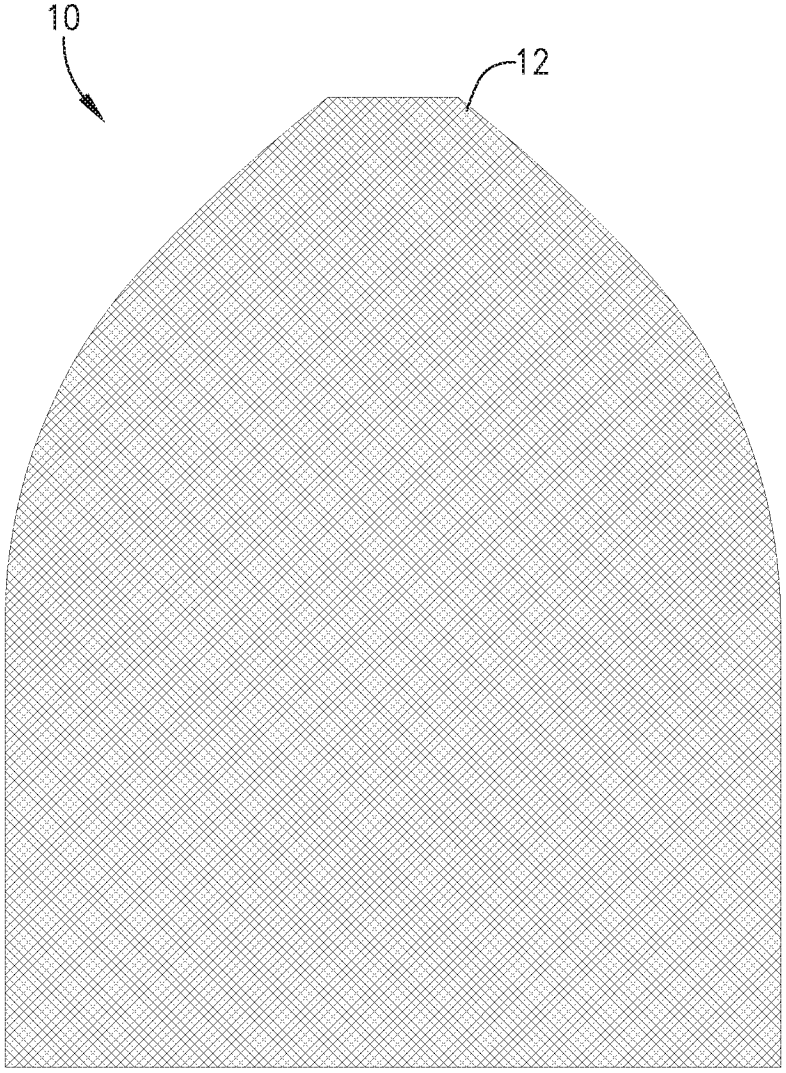
FIG. 1 depicts the textile substrate forming the body of a cap panel.

The embroidery method first begins by choosing a substrate or lining that will form the base of the cap panel. Generally, a light lining can be used as a base substrate. As shown in FIG. 1, a cap panel body 10 in the shape of the cap panel can be outlined in the lining 12. The cap panel body 10 will be used as the substrate to form the embroidered cap panels.

Preferably, the lining 12 comprises a lightweight and breathable material. In various embodiments, the lining comprises a textile substrate. In one or more embodiments, the lining comprises a nonwoven material or a woven material.

Furthermore, the lining can be formed from a synthetic material and/or a natural material. Exemplary synthetic materials can comprise polyester, nylon, rayon, acrylic, or any other lightweight synthetic material. The natural materials can comprise, for example, cellulose-based materials, cotton, hemp, wool, or any other lightweight natural materials.

These various materials for the lining (e.g., a polyester, spandex, cotton, wool, or other type of material) may have a wide range of different air permeabilities, depending on various factors associated with the specific material sample. For instance, the air permeability may depend on various characteristics of the material such as: thread or fiber thickness; thread or fiber count; yarn twist; weave or knit density; weave or knit construction; material or weave flexibility or stretchability; the presence or absence of mesh openings (or other openings); the mesh or opening size; the percentage of material surface area covered by mesh or openings; fabric thickness; number of plies; and/or finishing treatments.

In various embodiments, the lining can comprise a basis weight of less than 400, 300, 250, 200, 190, 180, 170, 160, 150, 140, 135, 130, 125, 120, 115, or 110 gsm. Additionally or alternatively, the lining can comprise a basis weight of at least 25, 50, 65, 70, 75, 80, 85, 90, 95, 100, 105, 110, 115, 120, 125, or 130 gsm.

Figure 2:
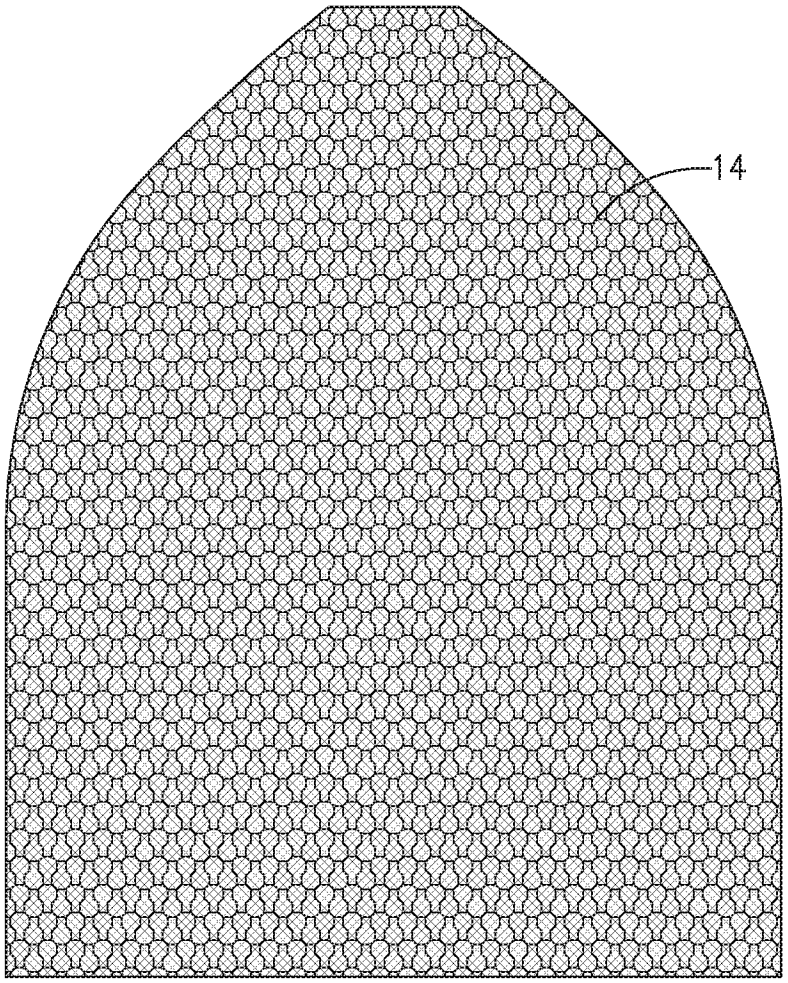
FIG. 2 depicts the first embroidery layer embroidered on the textile substrate.

Next, as shown in FIG. 2, the first embroidered layer 14 can be embroidered onto the lining/substrate using an embroidering machine with a specific thread. In certain embodiments, this embroidering step can be carried out with an embroidering machine using Size 9 and/or Size 11 embroidery needles. During this first embroidering step, the embroidery design or pattern is inputted into the computer of the embroidery machine and the machine embroiders the design or pattern onto the lining/substrate.

Embroidery generally involves using a needle to apply a thread or yarn onto a textile fabric in order to create a pattern thereon. Machine embroidery is a type of embroidery process wherein an embroidery machine is used to produce patterns on a textile substrate. In various embodiments, the machine embroidery utilizes a machine with multiple heads and threads that is controlled by a computer. Such machines generally have a hooping or framing system that holds the framed textile substrate in place under the sewing needle and moves the substrate automatically to create the design programmed into the computer.

Additionally, in various embodiments, the embroidery machine may comprise multiple sewing heads, each of which may sew the same or different designs onto the textile substrate concurrently. For instance, the embroidery machine may comprise at least 1, 2, 3, 4, 5, 6, 7, 8, 9, or 10 heads. Generally, each sewing head is capable of producing various embroidery effects, such as satin stitch embroidery, chain stitch embroidery, sequins, appliqué, and cutwork. The digital embroidery designs may be loaded onto the computer controlling the embroidery machine, which will then embroider the design onto the textile substrate.

Furthermore, in various embodiments, the sewing heads may comprise one or more needle colors per head. For instance, each of the heads in the embroidery machine may comprise at least 1, 2, 3, 4, 5, 6, or 7 sewing needles with different colors.

In various embodiments, the lining is stabilized via a hoop and/or a stabilizer (e.g., a backing) before the embroidering begins. For instance, the hoop can help move the textile substrate during the embroidering process in relation to the sewing needle. The stabilizer can comprise a backing that is placed inside or under the textile substrate and can comprise a cutaway backing or tear-away backing.

Moreover, in any of the embroidering steps described herein, the rotational speed of the embroidering needle in the embroidering machine can be at least 250, 500, or 700 rpm and/or less than 2,000, 1,500, or 1,000 rpm during the embroidering steps.

Turning back to FIG. 2, the first embroidered layer 14 can form a first pattern or design and may cover at least 50, 75, 80, 85, 90, 95, or 99 percent of the surface area of at least one surface of the lining. In certain embodiments, the first embroidered layer can cover substantially all or all of the surface area of at least one surface of the lining.

Figure 3:
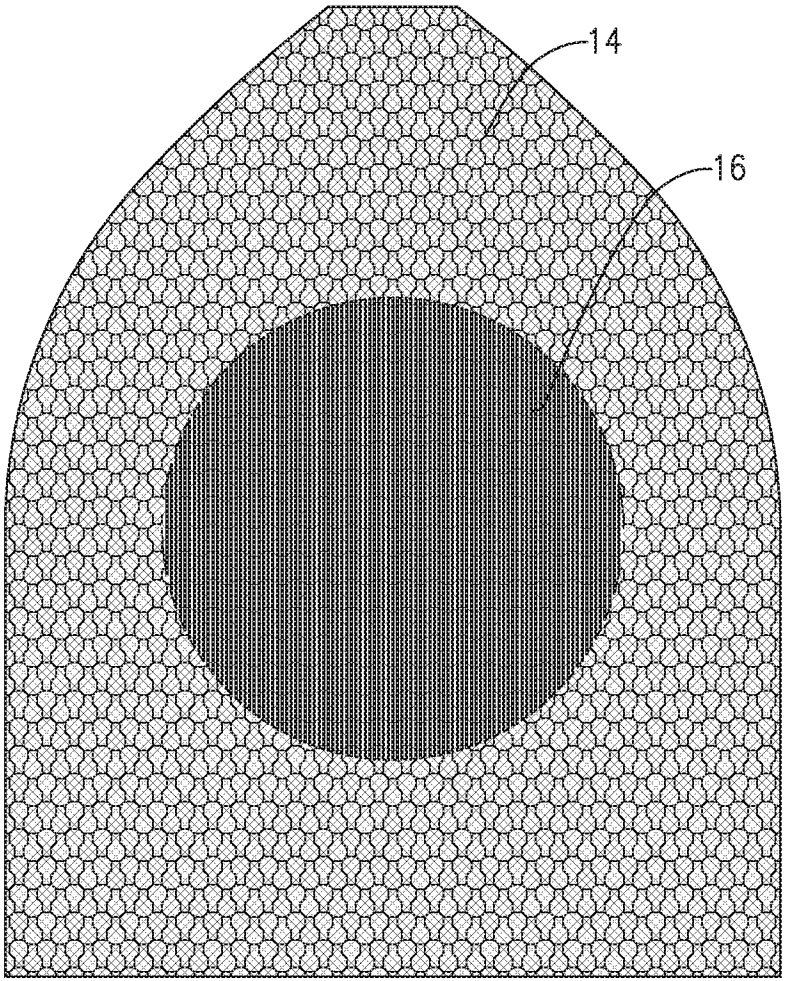
FIG. 3 depicts the second embroidery layer embroidered on top of the first embroidery layer.

Next, as shown in FIG. 3, the second embroidered layer 16 can be embroidered on at least a portion of the first embroidered layer 14 using an embroidering machine with a specific thread. In certain embodiments, this embroidering step can be carried out with an embroidering machine using Size 9 and/or Size 11 embroidery needles. During this second embroidering step, the embroidery design or pattern is inputted into the computer of the embroidery machine and the machine embroiders the design or pattern onto the first embroidering layer. Consequently, the design is layered by adding a dimension through the first embroidered layer. Furthermore, the design of the second embroidered layer generally has a different design from the first embroidered layer.

Turning back to FIG. 3, the second embroidered layer 16 can form a second pattern or design and may cover at least 1, 5, 10, 15, 20, 25, 30, 35, 40, 45, or 50 percent of the surface area of the first embroidered layer 14. Additionally or alternatively, the second embroidered layer 16 may cover less than 99, 95, 90, 80, 70, 60, 50, 40, 30, or 20 percent of the surface area of the first embroidered layer 14.

Figure 4:
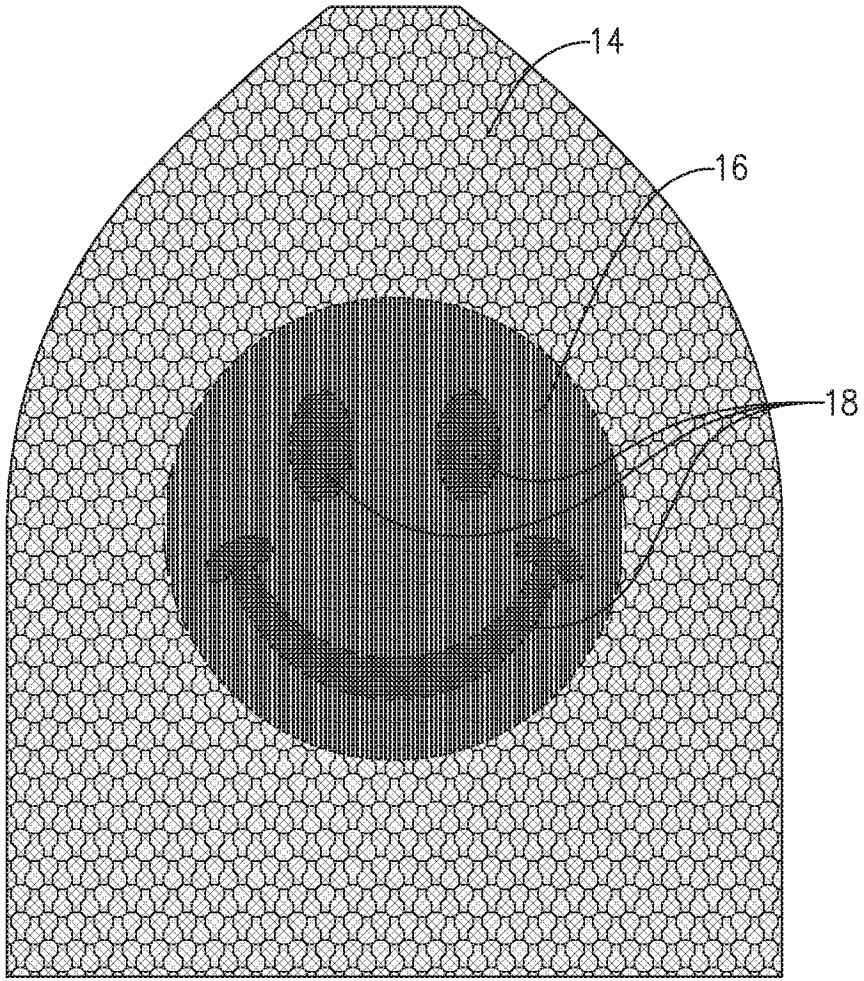
FIG. 4 depicts the third embroidery layer embroidered on top of the second embroidery layer.

Next, as shown in FIG. 4, the third embroidered layer 18 can be embroidered on at least a portion of the first embroidered layer 14 and/or on at least a portion of the second embroidered layer 16 using an embroidering machine with a specific thread. In certain embodiments, this embroidering step can be carried out with an embroidering machine using Size 9 and/or Size 11 embroidery needles. During this third embroidering step, the embroidery design or pattern is inputted into the computer of the embroidery machine and the machine embroiders the design or pattern onto the first embroidering layer and/or second embroidering layer. Consequently, the design is layered by adding a dimension through the first embroidered layer and/or the second embroidered layer. Furthermore, the design of the third embroidered layer generally has a different design from the first embroidered layer and the second embroidered layer.

Turning back to FIG. 4, the third embroidered layer 18 can form a third pattern or design and may cover at least 1, 5, 10, 15, 20, 25, 30, 35, 40, 45, or 50 percent of the surface area of the first embroidered layer 14 and/or the second embroidered layer 16. Additionally or alternatively, the third embroidered layer 18 may cover less than 99, 95, 90, 80, 70, 60, 50, 40, 30, or 20 percent of the surface area of the first embroidered layer 14 and/or the second embroidered layer 16.

Although not depicted in FIGS. 1-4, additional embroidered layers may be applied on at least a portion of the first embroidered layer, the second embroidered layer, and/or the third embroidered layer in certain embodiments. For example, at least 1, 2, 3, or 4 additional embroidered layers may be applied on at least a portion of the first embroidered layer, the second embroidered layer, and/or the third embroidered layer. In various embodiments, the embroidered headwear panel can comprise at least 3, 4, 5, or 6 and/or less than 20, 15, or 10 embroidered layers.

In various embodiments, the embroidered headwear panel can comprise at least 25,000, 40,000, 50,000, 60,000, 70,000, or 80,000 embroidery stitches and/or less than 500,000, 400,000, or 300,000 embroidery stitches.

In various embodiments, the embroidering steps of the present invention do not involve knitting or weaving steps. Thus, only embroidering techniques are utilized to apply the above-referenced embroidery layers of the present invention.

Various embroidering techniques may be used depending on the desired pattern and design incorporated onto the headwear panels. For instance, the first embroidered layer, the second embroidered layer, and/or the third embroidered layer can comprise a flat embroidery layer and/or a 3D embroidery layer.

Additionally, in various embodiments, the threads used to produce the various embroidery layers of the present invention can comprise polyester, rayon, cotton, acrylic, wool, or combinations thereof. In certain embodiments, the same type of thread is used to produce all of the embroidery layers of the embroidered cap panel. For example, the thread used to produce the first embroidery layer, the second embroidery layer, and the third embroidery layer can comprise polyester.

Alternatively, the threads used to produce the various embroidery layers of the embroidered cap panel can comprise different thread types. For instance, the first embroidered layer can comprise cotton thread, the second embroidered layer can comprise polyester thread, and the third embroidered layer can comprise acrylic thread.

In various embodiments, the threads forming the embroidered layers can be different colors so as to further distinguish and enhance the formed patterns or designs. Alternatively, the threads forming the embroidered layers can be of the same color.

The above-referenced embroidering steps can be used to produce a plurality of embroidered cap panels, which can be sewn together to form the embroidered caps. In particular, the completed embroidered panels may be cut from the lining (if not already done so) and sewn together to complete construction of the headwear.

The embroidered headwear produced from the embroidery method of the present invention can include, for example, caps, beanies, visors, and any other type of headwear that can be produced by sewing panels together.

As noted above, despite containing multiple embroidery layers applied thereon, the embroidered headwear of the present invention is still very lightweight and breathable. Thus, not only do the above-referenced embroidered layers enhance the aesthetic features of the headwear, but they also have a minimal impact on the weight and breathability of the embroidered headwear. Consequently, the embroidered headwear of the present invention, unlike conventional embroidered headwear, can be very lightweight and breathable, thereby enhancing the comfort of the wearer.

In various embodiments, the embroidered headwear panels formed according to the above-described embroidering methods can be very lightweight. For instance, in various embodiments, the embroidered headwear panel can comprise a basis weight of at least 25, 50, 65, 70, 75, 80, 85, 90, 95, 100, 105, 110, 115, 120, 125, or 130 gsm. Additionally or alternatively, the embroidered headwear panel comprises a basis weight of less than 400, 300, 250, 200, 190, 180, 170, 160, 150, 140, 135, 130, 125, 120, 115, or 110 gsm.

Furthermore, in various embodiments, the embroidered headwear panels can comprise a weight of at least 4, 5, 6, 7, or 8 grams and/or less than 25, 20, or 18 grams as measured using a conventional metric scale. Additionally or alternatively, the embroidered headwear formed from the embroidered headwear panels can comprise a weight of at least 50, 60, 70, 80, or 90 grams and/or less than 200, 180, 160, 140, or 120 grams as measured using a conventional metric scale.

Additionally, in various embodiments, the embroidered headwear panels formed with the above-described embroidering methods can be highly breathable. For instance, the embroidered headwear panel can exhibit an air permeability of at least 400, 450, 500, 550, 600, 650, 700, 750, 800, 850, or 900 $ft^3$/min per $ft^2$ as measured according to ASTM D737-96. "Air permeability," as used herein, means the volume of air (e.g., in cubic feet) that passes through a given area of the material tested (e.g., a square foot) in a given time period (e.g., a minute) under predetermined testing conditions. While various methods of measuring air permeability are known and used, one suitable method of measuring air permeability involves the use of a Frazier Low Pressure Air Permeability Machine 750 using standard test ASTM D737-96.

Similarly, in various embodiments, the embroidered headwear panels formed according to the above-described embroidering methods can exhibit a RET breathability rating of less than 13, 12, 11, 10, 9, 8, 7, 6, 5, 4, 3, 2, or 1 $R_{et}$ as measured according to ISO 11092.

Definitions

It should be understood that the following is not intended to be an exclusive list of defined terms. Other definitions may be provided in the foregoing description, such as, for example, when accompanying the use of a defined term in context.

As used herein, the terms "a," "an," and "the" mean one or more.

As used herein, the term "and/or," when used in a list of two or more items, means that any one of the listed items can be employed by itself or any combination of two or more of the listed items can be employed. For example, if a composition is described as containing components A, B, and/or C, the composition can contain A alone; B alone; C alone; A and B in combination; A and C in combination, B and C in combination; or A, B, and C in combination.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the terms "having," "has," and "have" have the same open-ended meaning as "comprising," "comprises," and "comprise" provided above.

As used herein, the terms "including," "include," and "included" have the same open-ended meaning as "comprising," "comprises," and "comprise" provided above.

As used herein, the terms "first," "second," "third," and the like are used to describe various elements and such elements should not be limited by these terms. These terms are only used to distinguish one element from another and do not necessarily imply a specific order or even a specific element. For example, an element may be regarded as a "first" element in the description and a "second" element in the claims without departing from the scope of the present invention. Consistency is maintained within the description and each independent claim, but such nomenclature is not necessarily intended to be consistent therebetween.

As used herein, the terms "lining" and "substrate" may be used interchangeably.

Numerical Ranges

The present description uses numerical ranges to quantify certain parameters relating to the invention. It should be understood that when numerical ranges are provided, such ranges are to be construed as providing literal support for claim limitations that only recite the lower value of the range as well as claim limitations that only recite the upper value of the range. For example, a disclosed numerical range of 10 to 100 provides literal support for a claim reciting "greater than 10" (with no upper bounds) and a claim reciting "less than 100" (with no lower bounds).

Claims not Limited to Disclosed Embodiments

The preferred forms of the invention described above are to be used as illustration only, and should not be used in a limiting sense to interpret the scope of the present invention. Modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as it pertains to any apparatus not materially departing from but outside the literal scope of the invention as set forth in the following claims.

What is claimed is:

1. A method for producing embroidered headwear, said method comprising:

(a) providing a substrate in the shape of a headwear panel;

(b) embroidering a first embroidered layer with a first thread on a surface of said substrate, wherein said first embroidered layer covers at least 90 percent of said surface of said substrate;

(c) embroidering a second embroidered layer with a second thread on at least a portion of said first embroidered layer; and (d) embroidering a third embroidered layer with a third thread on at least a portion of said first embroidered layer and/or on at least a portion of said second embroidered layer to thereby produce an embroidered headwear panel.

2. The method according to claim 1, wherein said embroidered headwear panel comprises a basis weight of less than 160 gsm and exhibits an air permeability of at least 400 $ft^3$/min per $ft^2$ as measured according to ASTM D737-96.

3. The method according to claim 1, wherein said first embroidered layer covers at least 99 percent of said surface.

4. The method according to claim 1, wherein said first thread, said second thread, and said third thread are selected from the group consisting of polyester, rayon, cotton, acrylic, wool, and a combination thereof.

5. The method according to claim 1, wherein said first thread, said second thread, and said third thread comprise the same type of thread.

6. The method according to claim 1, wherein said substrate comprises a basis weight in the range of 25 to 200 gsm.

7. The method according to claim 1, wherein said embroidering of steps (b), (c), and (d) are performed by an embroidery machine with Size 9 embroidering needles and/or Size 11 embroidering needles.

8. The method according to claim 1, further comprising embroidering a fourth embroidered layer comprising a fourth thread on at least a portion of said first embroidered layer, said second embroidered layer, and/or said third embroidered layer.

9. A method for producing embroidered headwear, said method comprising:

(a) providing a substrate in the shape of a headwear panel;

(b) embroidering a first embroidered layer with a first thread on a surface of said substrate, wherein said first embroidered layer covers at least 95 percent of said surface of said substrate;

(c) embroidering a second embroidered layer with a second thread on at least a portion of said first embroidered layer;

(d) embroidering a third embroidered layer with a third thread on at least a portion of said first embroidered layer and/or on at least a portion of said second embroidered layer to thereby produce an embroidered headwear panel, wherein said embroidered headwear panel comprises a basis weight of less than 160 gsm and exhibits an air permeability of at least 400 $ft^3$/min per $ft^2$ as measured according to ASTM D737-96;

(e) repeating steps (a) to (d) to produce a second embroidered headwear panel; and (f) sewing said embroidered headwear panel and said second embroidered headwear panel together to form said embroidered headwear.

10. The method according to claim 9, wherein said first embroidered layer covers at least 99 percent of said surface.

11. The method according to claim 9, wherein said first thread, said second thread, and said third thread are selected from the group consisting of polyester, rayon, cotton, acrylic, wool, and a combination thereof.

12. The method according to claim 9, wherein said first thread, said second thread, and said third thread comprise the same type of thread.

13. The method according to claim 9, wherein said substrate comprises a basis weight in the range of 25 to 200 gsm.

14. The method according to claim 9, wherein said embroidering of steps (b), (c), and (d) are performed by an embroidery machine with Size 9 embroidering needles and/or Size 11 embroidering needles.

15. The method according to claim 9, further comprising embroidering a fourth embroidered layer comprising a fourth thread on at least a portion of said first embroidered layer, said second embroidered layer, and/or said third embroidered layer.

16. An embroidered headwear, said embroidered headwear comprising at least one embroidered headwear panel, wherein said embroidered headwear panel comprises:

(a) a substrate forming the shape of said embroidered headwear panel;

(b) a first embroidered layer comprising a first thread embroidered on a surface of said substrate, wherein said first embroidered layer covers at least 95 percent of said surface of said substrate;

(c) a second embroidered layer comprising a second thread embroidered on at least a portion of said first embroidered layer; and (d) a third embroidered layer comprising a third thread embroidered on at least a portion of said first embroidered layer and/or said second embroidered layer, wherein said embroidered headwear panel comprises a basis weight of less than 160 gsm and exhibits an air permeability of at least 400 $ft^3$/min per $ft^2$ as measured according to ASTM D737-96.

17. The embroidered headwear according to claim 16, wherein said first embroidered layer covers at least 99 percent of said surface.

18. The embroidered headwear according to claim 16, wherein said first thread, said second thread, and said third thread are selected from the group consisting of polyester, rayon, cotton, acrylic, wool, or a combination thereof.

19. The embroidered headwear according to claim 16, wherein said first thread, said second thread, and said third thread comprise the same type of thread.

20. The embroidered headwear according to claim 16, wherein said substrate comprises a basis weight in the range of 25 to 200 gsm.

* * * * *